US009470376B2

(12) United States Patent
Lu

(10) Patent No.: US 9,470,376 B2
(45) Date of Patent: Oct. 18, 2016

(54) MODULARIZED LED LAMP TUBE

(71) Applicant: TAIWAN ADVANCE EL TECHNOLOGY LTD., Kaohsiung (TW)

(72) Inventor: Ching-Yu Lu, Kaohsiung (TW)

(73) Assignee: TAIWAN ADVANCE EL TECHNOLOGY CO., LTD., Kaohsiung (TW)

( * ) Notice: Subject to any disclaimer, the term of this patent is extended or adjusted under 35 U.S.C. 154(b) by 0 days.

(21) Appl. No.: 14/720,981

(22) Filed: May 26, 2015

(65) Prior Publication Data

US 2015/0377423 A1 Dec. 31, 2015

(30) Foreign Application Priority Data

Jun. 27, 2014 (TW) ..... 103211370 A

(51) Int. Cl.

| | |
|---|---|
| ***F21V 23/00*** | (2015.01) |
| ***F21S 4/00*** | (2016.01) |
| ***F21K 99/00*** | (2016.01) |
| ***F21V 23/06*** | (2006.01) |
| *F21Y 103/00* | (2016.01) |

(52) U.S. Cl.
CPC ..... *F21K 9/175* (2013.01); *F21V 23/06* (2013.01); *F21Y 2103/003* (2013.01)

(58) Field of Classification Search
CPC ..... F21K 9/175; F21Y 2103/003; F21V 19/0045; F21V 19/0055; F21V 23/06; F21V 7/005
See application file for complete search history.

(56) References Cited

U.S. PATENT DOCUMENTS

| | | | | |
|---|---|---|---|---|
| 9,228,727 | B2 * | 1/2016 | May | F21S 8/04 |
| 9,388,948 | B2 * | 7/2016 | Demuynck | F21K 9/175 |
| 2012/0300460 | A1 * | 11/2012 | Liu | F21V 19/02 362/249.02 |

FOREIGN PATENT DOCUMENTS

| | | | | |
|---|---|---|---|---|
| EP | 2489929 | * | 8/2012 | F21V 29/00 |

* cited by examiner

*Primary Examiner* — Peggy Neils
(74) *Attorney, Agent, or Firm* — Leong C. Lei

(57) ABSTRACT

The LED lamp tube contains a tubular body, a lighting module, end circuit boards, positioning elements, and caps. The lighting module contains a circuit board attached to a metallic base, LED chips on the circuit board, and first connectors at the ends of the circuit board. Each end circuit board contains two conductive pins and a second connector. Each positioning element has first through holes on an end surface. Each cap has a cylindrical shape with second through holes. The lighting module is threaded into the tubular body. Each end circuit board is plugged into a positioning element which in turn is plugged into a cap, and the conductive pins run through the first and second through holes. Each cap is joined to an end of the tubular body, and each first connector of the lighting module is connected to the second connector of an end circuit board.

3 Claims, 3 Drawing Sheets

MODULARIZED LED LAMP TUBE

BACKGROUND OF THE INVENTION (a) Technical Field of the Invention

The present invention is generally related to lamp tubes, and more particular to modularized tamp tubes using light emitting diodes (LEDs).

(b) Description of the Prior Art

In recent years light emitting diodes (LEDs) have been widely applied to various lamps. Among them, the LED lamp tubes, due to their low power consumption and enhanced brightness, gradually replace the conventional fluorescent lamp tubes. The existing LED lamp tubes contain a tubular body, a circuit board, LEDs, and two conductive caps. The LEDs are welded to the circuit board, and the circuit board is threaded into the tubular body. Then a number of conductive wires is used to electrically connect the circuit board to the two conductive caps, which are fixed to the two ends of the tubular body. As electricity is applied to the two conductive caps, electricity drives the LEDs to illuminate through the circuit board. As described above, there are multiple welding steps involved and the assembly time is as such increased. In addition, as the above components are connected together mainly through welding, once one of the components is damaged or broken down, the entire LED lamp tube has to be replaced, which is not only costly but also less environmentally friendly.

SUMMARY OF THE INVENTION

Therefore a major objective of the present invention is to provide a modularized LED lamp tube with enhanced brightness and coverage. The modularized Led lamp tube is convenient to assembly and maintain so as to obviate the shortcomings of the prior art.

The LED lamp tube contains a tubular body, a lighting module, end circuit boards, positioning elements, and caps. The lighting module contains a circuit board attached to a metallic base, LED chips on the circuit board, and first connectors at the ends of the circuit board. Each end circuit board contains two conductive pins and a second connector. Each positioning element has first through holes on an end surface. Each cap has a cylindrical shape with second through holes. The lighting module is threaded into the tubular body. Each end circuit board is plugged into a positioning element which in turn is plugged into a cap, and the conductive pins run through the first and second through holes. Each cap is joined to an end of the tubular body, and each first connector of the lighting module is connected to the second connector of an end circuit board.

Preferably, the base is aluminum-extruded to provide enhanced strength and heat dissipation. The base can has two reflective wing pieces, each slantwise extended from the bottom side and running axially along a major edge of the base so as to concentrate light from the LED chips, thereby enhancing the brightness of the LED lamp tube.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
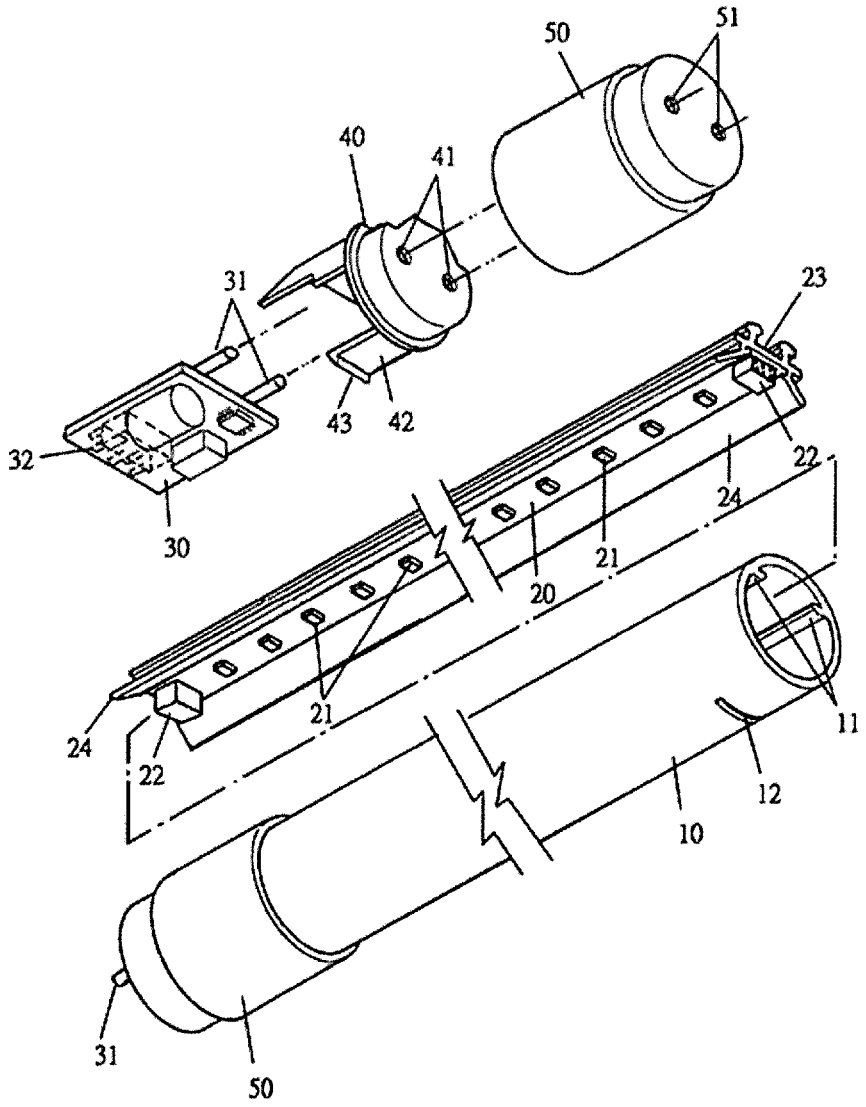
FIG. 1 is a perspective break-down diagram showing the various components of a modularized LED lamp tube according to an embodiment of the present invention.
Figure 2:
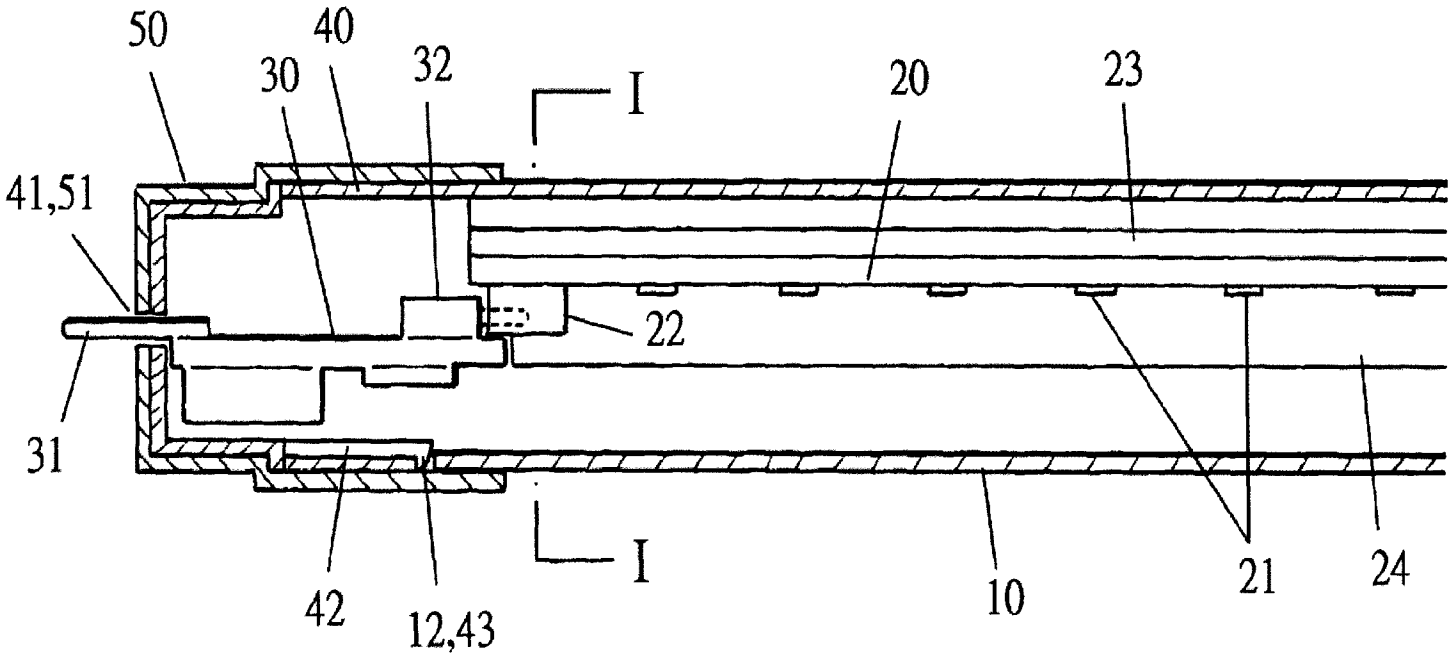
FIG. 2 is a sectional diagram showing the modularized LED lamp tube of FIG. 1.
Figure 3:
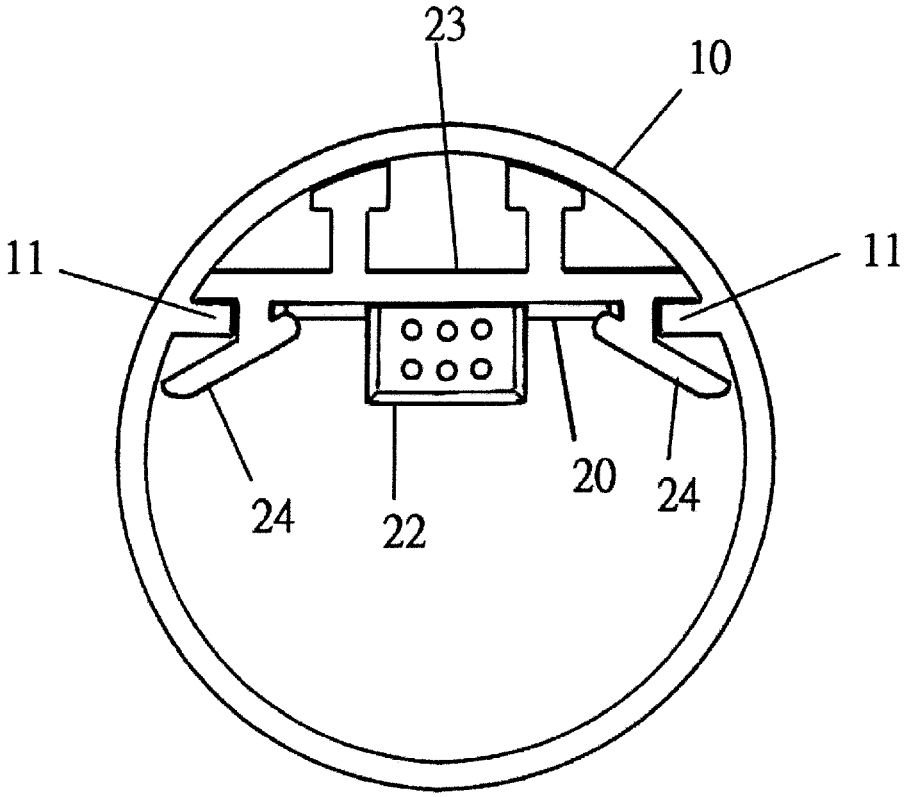
FIG. 3 is a cross-sectional diagram showing the modularized LED lamp tube along the I-I line of FIG. 2.

FIG. 1 is a perspective break-down diagram showing the various components of a modularized LED lamp tube according to an embodiment of the present invention. FIG. 2 is a sectional diagram showing the modularized LED lamp tube of FIG. 1. FIG. 3 is a cross-sectional diagram showing the modularized LED lamp tube along the I-I line of FIG. 2. As illustrated, the modularized LED lamp tube contains a tubular body 10, a lighting module 20, two end circuit boards 30, two positioning elements 40, and two caps 50.

The tubular body 10 is made of a material of enhanced transparency. Two lateral protrusions 11 are correspondingly configured on an inner wall of the tubular body 10 along an axial direction. Adjacent to each end of the tubular body 10, an arc slot 12 is configured on a circumference of the tubular body 10.

The lighting module 20 contains a number of LED chips 21 serially configured on an elongated circuit board (not numbered). At each end of the circuit board, a first connector 22 is configured. The circuit board is attached to a bottom side of an elongated metallic base 23. The lighting module 20 is positioned between two reflective wing pieces 24 of the base 23. Each wing piece 24 is slantwise extended from the bottom side running axially along a major edge of the base 23. The base 23, along with the attached lighting module 20, can be threaded into the tubular body 10 and supported by the two protrusions 11.

The base 23 is made by aluminum extrusion and therefore has an enhanced strength and heat dissipation capability.

Each end circuit board 30 contains conversion and regulating circuits, two conductive pins 31, and a second connector 32.

Each positioning element 40 is for holding an end circuit board 30, has two through holes 41 on a circular end surface, allowing the conductive pins 31 to run through. Along a circumference of the circular end surface, a flexible piece 42 with a hook 43 at an end is axially extended.

Each cap 50 has a cylindrical shape with two through holes 51 on an end surface. Each positioning element 40 is plugged into a cap 50, and the conductive pins 31 of the end circuit board 30 run through the through holes 51.

As described above, each end circuit board 30 is joined to a positioning element 40, which in turn is joined to a cap 50. The conductive pins 31 of each end circuit board 30 are exposed from the through holes 41 and 51.

The assembly that includes an end circuit board 30, a positioning element 40, and a cap 50 is joined to an end of the tubular body 10 with the hook 43 of the flexible piece 42 of the positioning element 40 locked into an arc slot 12 at an end of the tubular body 10. While the assembly is securely and reliably configured to the tubular body 10, the first connector 22 of the lighting module 20 is connected to the second connector 32 of the end circuit board 30.

The present invention provides the following advantages.

Firstly, the modularized components (i.e., the tubular body 10, the lighting module 20, the end circuit boards 30, the positioning elements 40, and the caps 50) of the LED lamp tube provides convenient assembly and reduced labor. Especially, when one of the components breaks down, only the broken component requires replacement, thereby saving significant cost and achieving environmental friendliness.

Secondly, the base 23 is an aluminum-extruded piece with enhanced strength and heat dissipation capability. Therefore, when a longer LED lamp tube is desired, the base 23 provides the required structural reinforcement, and the LED lamp tube does not deform due to its extended length. Additionally, the heat produced by the lighting module 20 is effectively dissipated by the base 23, avoiding the deterioration or burning down to the LED lamp tube resulted from the high temperature and thereby achieving an extended operation life span of the LED lamp tube.

Thirdly, the two reflective wing pieces 24 besides the LED chips 21 help concentrating the light from the LED chips 21, thereby enhancing the brightness of the LED lamp tube.

Furthermore, the modularized components (i.e., the tubular body 10, the lighting module 20, the end circuit boards 30, the positioning elements 40, and the caps 50) can be put together without welding and no metallic parts are exposed. The workers or the users are prevented from the hazard of electrical shock, providing enhanced safety.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A lamp tube, comprising:

a tubular body made of a transparent material where two lateral protrusions are correspondingly configured on an inner wall of the tubular body along an axial direction;

an elongated metallic base;

a lighting module comprising an elongated circuit board, a plurality of light emitting diode (LED) chips configured on the circuit board, and two first connectors, where each first connector is configured at an end of the circuit board, and the circuit board is attached to a bottom side of the base;

two end circuit boards, each comprising two conductive pins and a second connector;

two positioning elements, each having two first through holes on a circular end surface; and two caps, each having a cylindrical shape with two second through holes on an end surface;

wherein the base, along with the attached lighting module, is threaded into the tubular body and supported by the two protrusions;

each end circuit board is plugged into a positioning element which in turn is plugged into a cap, and the conductive pins of the end circuit board run through the first and second through holes; and each assembly that includes an end circuit board, a positioning element, and a cap is joined to an end of the tubular body, and each first connector of the lighting module is connected to the second connector of an end circuit board.

2. The lamp tube according to claim 1, wherein an arc slot is configured on a circumference adjacent to each end of the tubular body; a flexible piece with a hook at an end is axially extended along a circumference of the circular end surface of each positioning element;

and the hook of each flexible piece is locked into an arc slot at an end of the tubular body.

3. The lamp tube according to claim 1, wherein the base is aluminum-extruded; the base has two reflective wing pieces, each slantwise extended from the bottom side and running axially along a major edge of the base.

* * * * *